United States Patent [19]

Hepworth et al.

[11] Patent Number: 4,804,033

[45] Date of Patent: Feb. 14, 1989

[54] PRODUCTION OF ENGINEERING COMPONENTS

[75] Inventors: William J. Hepworth, Hampton-in-Arden; Albert E. Bolton, Sutton Coldfield, both of England

[73] Assignee: AE PLC, Rugby, England

[21] Appl. No.: 885,719

[22] Filed: Jul. 15, 1986

[30] Foreign Application Priority Data

Jul. 26, 1985 [GB] United Kingdom ..... 8518909

[51] Int. Cl.[4] ..... B22D 19/14; B22D 13/06

[52] U.S. Cl. ..... 164/97; 164/114

[58] Field of Search ..... 164/97, 98, 114, 115, 164/116, 117, 118

[56] References Cited

FOREIGN PATENT DOCUMENTS

| | | | |
|---|---|---|---|
| 0150240 | 8/1985 | European Pat. Off. . | |
| 2133852 | 12/1972 | France . | |
| 492351 | 12/1975 | U.S.S.R. | 164/97 |
| 502832 | 4/1939 | United Kingdom . | |
| 1393989 | 5/1975 | United Kingdom . | |
| 2106433A | 4/1983 | United Kingdom | 164/98 |

*Primary Examiner*—Kuang Y. Lin

*Attorney, Agent, or Firm*—William R. Hinds

[57] ABSTRACT

A process is described for the production of engineering components wherein the process comprises filling a die cavity within a die assembly with molten metal by utilizing centrifugal force, the die cavity being rotated about an axis remote from the actual component cavity at a rotational velocity sufficient to produce an acceleration of at least 200'g' on the molten metal in the die cavity. The production of a piston having a fibrous reinforcing insert is described.

15 Claims, 2 Drawing Sheets

PRODUCTION OF ENGINEERING COMPONENTS

The present invention relates to the production of engineering components by casting and particularly to such components for example having reinforcing inserts such as those made of fibres or whiskers.

Much research has been carried out over recent years to produce stronger, more wear-resistant components such as pistons, for example, for use in internal combustion engines or compressors.

One route which has been followed by many researchers to produce better components is that of incorporating inserts into the components. Such inserts may, for example, comprise shaped preforms of either metallic or non-metallic particles, fibres or whiskers. Examples of the former are stainless steel and nickel-based alloy wires, fibres or powder metallurgy components and examples of the latter are alumina, silica, zirconia, silicon carbide and silicon nitride. Generally speaking the insert should be porous or at least have a porous or fibrous surface into which the matrix metal of the component may penetrate in order to achieve a strong bond between metal and insert. Where the insert is porous throughout its bulk the matrix metal of the component should ideally completely impregnate the insert.

A well known process for the production of pistons is gravity-die casting. This technique, however, is not only unsuitable where porous inserts have to be incorporated but also cannot be relied upon to achieve absolute soundness even in a non-fibre reinforced casting. Gravity-die casting is unsuitable for incorporating porous inserts into castings because only minimal or at best incomplete impregnation of the insert is achieved. The effect of unsoundness or porosity in piston castings is to produce a wide spread of fatigue strengths at the piston operating temperature. A wide spread of fatigue strengths means that the average fatigue strength is correspondingly lower than that obtainable from completely sound material and that gravity-die cast pistons may be unsuitable for the more arduous applications.

To overcome the problems both of incomplete impregnation and unsoundness other casting techniques have been developed in recent years. One such technique now widely used is squeeze-casting wherein molten metal is poured into a female die cavity, the die cavity then being closed with a male die member and the molten metal allowed to solidify under a pressure, often of many kg/mm$^2$. Where the female die cavity also contains an insert to be impregnated squeeze-casting physically forces the liquid metal into the porous structure of the insert and because pressure on the metal is maintained during solidification porosity is prevented from forming. Thus sound material and where inserts are included, full impregnation thereof may be achieved.

Squeeze-casting usually requires the use of a hydraulic press which is both physically large and expensive. The cost of a press used in a squeeze-casting installation for the manufacture of diesel engine pistons of about 130 mm diameter is high. A characteristic of squeze-casting is that there is slight, though significant, relative movement between the male and female die members during solidification and cooling of the squeeze-cast material. The effect of this is to make the incorporation in castings of features such as gudgeon pin holes in pistons, for example, difficult.

It has now been discovered that components may be produced with material mechanical properties at least equivalent to the best gravity-die cast material and approaching the properties achieved by squeeze-casting on apparatus costing much less than that of apparatus required for the production of comparable sized squeeze-castings.

According to a first aspect of the present invention there is provided a process for the production of an engineering component, the process comprising the steps of rotating a die assembly having a cavity having a reinforcing insert therein and substantially of the shape of the component to be cast about a center of rotation remote from the die cavity, and introducing molten metal into the die cavity from an external supply when the die cavity is rotating at a desired speed, the speed of rotation of said die cavity being sufficient to produce an acceleration of at least 200'g' on the metal in the cavity.

There is provided according to a second aspect of the present invention an engineering component when made by the first aspect of the present invention.

It has been found that piston castings produced by the process of the invention do not possess the porosity seen in gravity die castings.

In a preferred embodiment of the present invention, the engineering component is a piston for an internal combustion engine or a compressor or the like, and the reinforcing insert is a porous insert of, for example, ceramic fibers or whiskers or metallic fibers, wires, particles, or the like, the reinforcing insert or inserts being in one or more of the crown, piston ring and gudgeon pin boss regions of the piston.

Preferably the rotational velocity is sufficient to produce an acceleration on the molten metal of 250 to 450'g'.

In one embodiment of the present invention which is a piston for an internal combustion engine it has been found that complete impregnation of a fibre insert having about 80% porosity may be achieved together with very high material mechanical properties compared with those obtained from similar gravity die-cast parts. Typically the improvements in alloy material properties have been about 30%.

Preferably a three-piece die comprising a split two-piece female die member and a single piece male die member may be used. The type of die described is typical of that used in a squeeze-casting installation but has the advantage in centrifugal-casting in that because the male die member is in fixed relationship to the female die member such features as gudgeon pin holes in a piston may be cast-in using core-pins. Because the core-pins used for producing such features may be metallic and may have a quenching effect on the cast metal the grain structure produced is very fine and again has superior properties in a region where it is most needed. However, because the only forces acting on the die are those due to centrifugal forces generated by die rotation the male die member and other core pins etc. may comprise ceramic materials such as, for example, silicon nitride to inhibit the premature freezing of particular regions of the casting by use of the insulating effect of the ceramic.

An additional advantage realised with centrifugal-casting as distinct from squeeze-casting is that with centrifugal-casting, there is the capability that, provided that the casting machine and die are made adequately strong, more components may be produced per machine cycle. If, for example, a two cavity squeeze-casting die were envisaged then twice the force would be required to produce the components. The number of castings per cycle is thus clearly press capacity limited. This is not so in centrifugal-casting where the force on the molten metal is generated by the rotational velocity and is the same for a given die cavity geometry and radial location regardless of the number of die cavities. There is naturally, however, a physical restriction on the number of die cavities which may be incorporated into a casting machine of a given size.

In order that the invention may be more fully understood an example will now be described by way of illustration only with reference to the accompanying drawings, of which:

Figure 1:
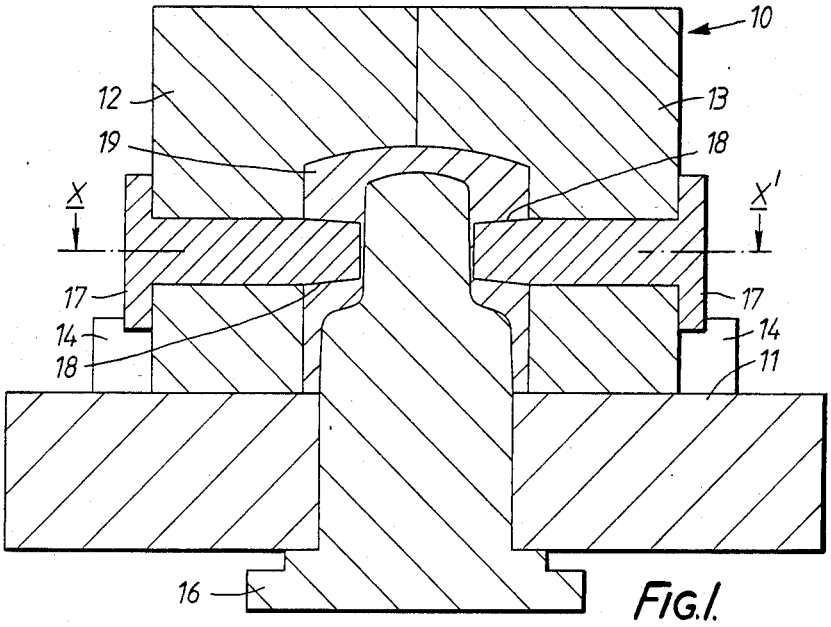
FIG. 1 shows in elevation a section through a die cavity for producing a piston by the process according to the invention.

Referring now to the drawings and where the same or similar features are identified by common reference numerals.

Figure 2:
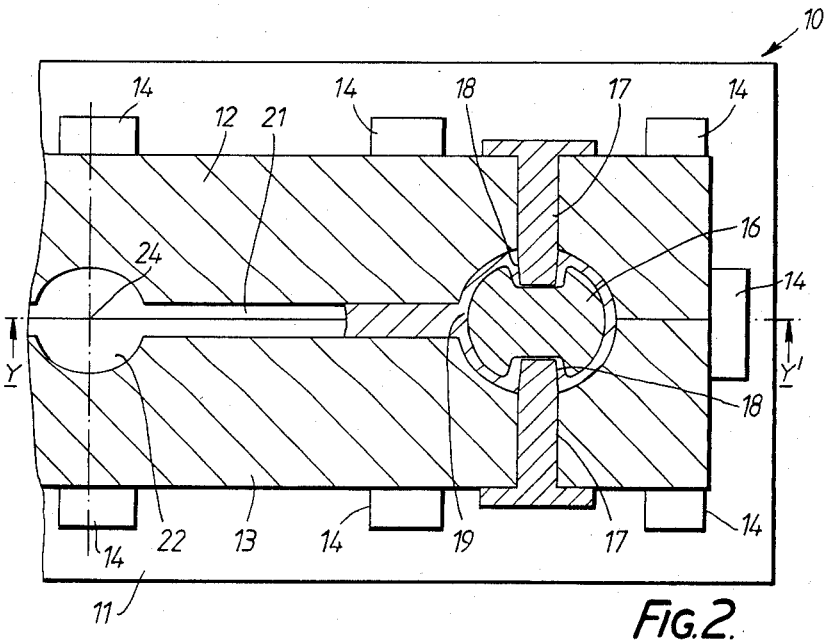
FIG. 2 shows in plan view a section through the line $XX^1$ of FIG. 1 of half of a die assembly for producing a piston by the process of the invention.
Figure 3:
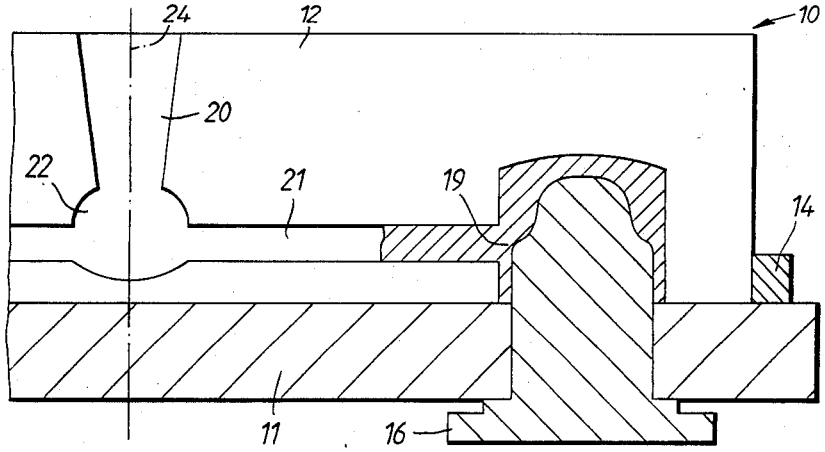
FIG. 3 shows in elevation a section through the line $YY^1$ of FIG. 2 of half of a die assembly for producing a piston by the process of the invention.

FIGS. 1 to 3 show various sections through a centrifugal-casting die assembly having a piston blank cast therein. The embodiment shown in these figures does not include inserts of any kind. The die assembly is shown generally at 10 and comprises a base-plate 11 affixable to which is a female die member being split in two halves 12 and 13. The die halves 12 and 13 are held together by clamping means 14 and to the base-plate 11 by further clamping means (not shown). Passing up through the base-plate 11 is a male die member 16 having no re-entrant angles and which may be easily withdrawn from a solidified piston casting. Passing through holes in the die halves 12 and 13 are core-pins 17 for producing in-situ gudgeon pin holes 18 in the piston casting 19. Included in the die halves 12 and 13 are channels forming the molten metal feeds 20 and 21 and a distribution chamber 22. A second die cavity 25 (not shown) is incorporated into the die assembly 10 the geometry of which is essentially symmetrical about the axis 24. The die assembly 10 is fixed to a rotatable bed (not shown) and is rotatable about the axis 24. The die 10 and rotatable bed are enclosed in suitable safety guards (not shown) to protect an operator in the event of a die burst or metal leakage. The rotatable bed is connected to suitable drive means (not shown) and speed control means (not shown) which are known in the art. A filling tube (not shown) co-operating with the feed channel 20 is provided through the safety guards and coincident with the axis 24 for filling the die 10 with molten metal from an external source.

In operation the die assembly 10 is pre-heated to a temperature dependent upon the metal to be cast and is rotated about the axis 24 at a rotational velocity such as to produce an acceleration within the range 250 to 450'g' in the region of the die cavity. Molten metal is poured via the filling tube (not shown) into the feed channel 20. The molten metal is then thrown by centrifugal action from the distribution chamber 22 into the channels 21 and thence into the die cavity formed between the die members 11, 12, 13, 16 and 17. As a result of the centrifugal force developed by die rotation on the molten metal air is expelled radially inwards in the opposite direction to metal flow. By suitable die design which may include preferential heating of particular die regions or insulation, for example, of feed channels solidification may be controlled such that the last metal to solidify is the feeder of the casting 19. Thus liquid metal is always present to feed developing shinkage porosity. Normal die design considerations such as the provision of air bleed channels etc. apply to the design of dies for centrifugal-casting.

In a die of the type described above where the diameter of the piston casting cavity is approximately 76 mm and the distance of the inner radial edge of the die cavity from the axis of rotation 24 is approximately 127 mm an acceleration of approximately 318'g' will be generated at the centre of the die cavity at a rotational velocity of 1500 rev/min.

Heat-treated material samples from pistons cast at 318'g' having the chemical composition in wt%; Cu/0.89-Mg/0.87-Si/11.16-Fe/0.37-Mn/0.11-Ni/0.99-Al remainder have given tensile strengths of between 18.4 and 19.5 t.s.i. Gravity-cast alloy of the same nominal composition gave strengths in the range 13.5 to 16 t.s.i. Furthermore, centrifugally cast material gave consistently higher fatigue strengths with little variation, similar in fact to the variation of results in tests for squeeze-cast material.

Figure 4:
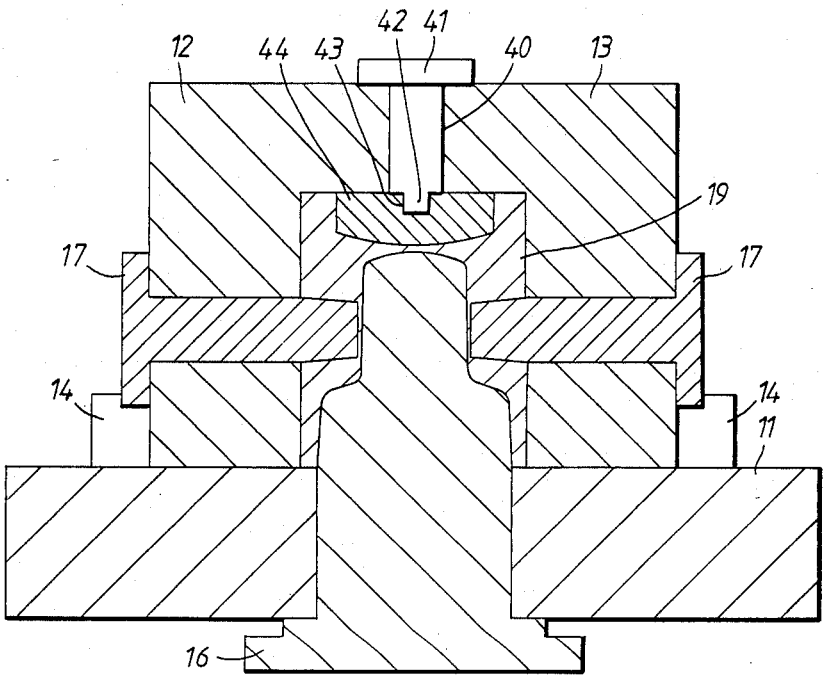
FIG. 4 shows a modification of the die cavity of FIG. 1 to incorporate an alumina fibre insert into the piston crown region.

Referring now to FIG. 4 which is similar to FIG. 1 but shows a die modified to allow incorporation of an alumina fibre insert into the crown region of the piston.

The die halves 12 and 13 are modified by inclusion of a hole 40 to receive a locator pin 41. The locator pin 41 has a spigot 42 on its lower end which is received into a recess 43 in an alumina fibre insert 44. The piston 19 was cast by the method described above. The aluminium-based piston alloy completely impregnated the fibre insert under the influence of the high 'g' accelerations generated. A photomicrograph was made of a section taken from a piston made in a die according to FIG. 4. The piston alloy known as Lo-Ex (trademark) appeared on the left of the photomicrograph while the fiber insert appeared on the right fully impregnated with Lo-Ex. The interface between the Lo-Ex and impregnated insert was seen to be fully continuous with no areas or regions of discontinuity.

Although the invention has been described showing fibre reinforcement of the crown area of a piston it is also envisaged that the piston-ring groove region and pin boss regions may also be so reinforced. The pin bosses may be reinforced by the provision of fibre preform annuli which may be placed on the pin boss core pins 17 for positioning purposes. The die halves 12, 13 may also incorporate location means for the positioning of piston-ring groove reinforcements. Such positioning means may comprise a groove or grooves around the die body cavity into which the fibre ring preform or preforms may be placed before closure of the die.

It is also envisaged that the process may also include the provision in the cast body of features having re-entrant angles such as, for example, combustion chamber bowls. Such features may be achieved by the use of salt cores in known manner. The fibre insert 44 of FIG. 4 may alternatively be considered as a salt core having a re-entrant form at the surface of the casting.

In a die assembly of the size described above it is possible to incorporate up to about four die cavities radially disposed about a centre of rotation.

It will be appreciated by those skilled in the art that modifications to the process described may be made. For example, relative orientations of components within the die may be altered and the die may be made to allow incorporation of Al-fin (trademark) type piston-ring groove reinforcement inserts.

Although the process of the invention has been described with respect to the production of pistons having improved properties over gravity cast material whether with or without reinforcement inserts the invention is clearly not limited to such. The production of other engineering components is also envisaged. Examples of such components include, connecting rods for internal combustion engines, blades for compressors and turbines, suspension components for motor vehicles etc. Such components may of course be produced having fibre reinforcement.

We claim:

1. A process for the production of an engineering component, the process comprising the steps of rotating a die assembly having a cavity having a reinforcing insert therein and substantially of the shape of the component to be cast about a center of rotation remote from said die cavity, introducing molten metal into said die cavity from an external supply after said die cavity is rotating at a desired speed wherein the speed of rotation of said die cavity is sufficient to produce an acceleration of at least 200'g' on said metal in said cavity.

2. A process according to claim 1 wherein the acceleration on said metal in said die cavity is between 250 and 450'g'.

3. A process according to claim 1 wherein said die assembly comprises at least a two-piece female die member and a single piece male die member.

4. A process according to claim 1 wherein said engineering component is a piston for an internal combustion engine or a compressor.

5. A process according to claim 4 wherein said die assembly further includes core pins for said piston gudgeon pin bosses.

6. A process according to claim 3 wherein said male die member comprises a ceramic.

7. A process according to claim 5 wherein said core pins comprise a ceramic.

8. A process according to claim 1 wherein said reinforcing insert is porous.

9. A process according to claim 8 wherein said reinforcing insert comprises ceramic fibers or whiskers.

10. A process according to claim 8 wherein said reinforcing insert comprises at least one of the group consisting of metallic fibers, wires and particles.

11. A process according to claim 1 wherein reinforcing inserts are in one or more of the crown, piston ring and gudgeon pin boss regions of a piston constituting the engineering component.

12. A process according to claim 4 wherein a salt core is contained within said die cavity in order to form a piston feature.

13. A process according to claim 12 wherein said piston feature is a combustion bowl in the crown region.

14. A process according to claim 1 wherein said die assembly has multiple die cavities.

15. A process according to claim 1 wherein said molten metal is an aluminium-based alloy.

* * * * *